US006768249B1

(12) United States Patent
Nasu et al.

(10) Patent No.: US 6,768,249 B1
(45) Date of Patent: Jul. 27, 2004

(54) SPARK PLUG AND PRODUCING METHOD THEREFOR

(75) Inventors: Hiroaki Nasu, Nagoya (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 490 days.

(21) Appl. No.: 09/645,599

(22) Filed: Aug. 25, 2000

(30) Foreign Application Priority Data

Aug. 25, 1999 (JP) ..... P. 11-238128

(51) Int. Cl.[7] ..... H01J 13/20
(52) U.S. Cl. ..... 313/118; 313/140
(58) Field of Search ..... 313/118, 141, 313/140, 144, 161, 139, 472, 40, 143; 428/472, 702; 148/267, 253

(56) References Cited

U.S. PATENT DOCUMENTS

| | | | | |
|---|---|---|---|---|
| 4,967,116 A | | 10/1990 | Oshima | 313/141 |
| 5,557,158 A | * | 9/1996 | Kanao et al. | 313/141 |
| 6,294,262 B1 | * | 9/2001 | Fukuoka | 428/472 |

FOREIGN PATENT DOCUMENTS

| | | | |
|---|---|---|---|
| DE | 196 15 664 A1 | 10/1997 | C23C/22/48 |
| DE | 196 38 176 | 4/1998 | C23C/22/48 |
| GB | 2 078 261 A | 1/1982 | C23F/7/00 |
| JP | 2000-48930 | 2/2000 | H01T/13/20 |

OTHER PUBLICATIONS

Patent Abstract of Germany 19638176, Apr. 16, 1989.
Patent Abstract of Japan 2000–48930, Feb. 18, 2000.
Japanese Abstract No. 01015396, dated Jan. 19, 1989.
Japanese Abstract No. 01015397, dated Jan. 19, 1989.

* cited by examiner

*Primary Examiner*—Ashok Patel
*Assistant Examiner*—Ken Berck
(74) *Attorney, Agent, or Firm*—Sughrue Mion, PLLC

(57) ABSTRACT

In a spark plug, a complex chromate coat 42 that contains a chromium component and a phosphorus component as cationic components, at least 90 wt % of the chromium component being trivalent chromium and the phosphorus component being present in an amount of 1 to 15 wt % as calculated for $PO_4$, is formed on the surface of the galvanized main metal shell 1 of a spark plug. If a silicon component is substituted for the phosphorus component, it may be present in an amount of 5 to 75 wt % as calculated for $SiO_2$.

16 Claims, 10 Drawing Sheets

SPARK PLUG AND PRODUCING METHOD THEREFOR

BACKGROUND OF THE INVENTION

1. Field of the Invention

The present invention relates to a spark plug for use on internal-combustion engines and a method for producing it.

2. Description of the Related Art

The spark plug used to ignite internal-combustion engines such as automotive gasoline engines comprises a central electrode, an insulator provided outside the central electrode, a main metal shell provided outside the insulator, and a ground electrode fitted on the main metal shell in a face-to-face relationship to define a spark discharge gap. A mounting threaded section is formed on the peripheral surface of the main metal shell and by means of this thread section the spark plug is mounted on the cylinder head of the engine for subsequent service.

The main metal shell is typically made of ferrous materials such as carbon steels and its surface is in most cases galvanized for protection against corrosion. The zinc plate layer exhibits good anti-corrosive action on iron. However, as is well known, the zinc plate layer on the iron substrate will easily be consumed by sacrificial corrosion, with the additional disadvantage that its appearance is prone to be damaged by the resulting zinc oxide which causes white discoloration. To deal with this problem, most spark plugs have the surface of the zinc plate layer further coated with a chromate coat so that it is protected against corrosion.

Spark plugs have heretofore been coated with the so-called "gold chromate coat" on the main metal shell. Because of its high performance in corrosion protection, the gold chromate coat is extensively used in non-spark plug applications such as coatings on the inner surfaces of food reserving cans. However, since part of the chromium component is contained in the hexavalent form, the use of the gold chromate coat is being gradually discouraged by the increasing global concern for environmental protection. In the automotive industry which is a massive user of spark plugs, a total ban in the future on the use of chromate coatings containing hexavalent chromium is being reviewed considering the possible environmental impact of waste spark plugs. As a further problem, the treating baths for depositing the gold chromate coatings contain relatively high concentrations of hexavalent chromium and huge cost is necessary to treat the waste effluents.

Under these circumstances, the development of chromate coatings free from hexavalent chromium, or those in which substantially all chromium component is in the trivalent form, has been underway for comparatively many years. The treating baths proposed to date are mostly low in the concentration of hexavalent chromium and some of them are entirely free from this form of chromium, thus contributing to alleviating the problem of effluent treatment. However, a major defect of the trivalent chromium based chromate coatings is that they are inferior to the gold chromate coatings in the ability to prevent corrosion and this is why they have not found extensive use as coatings to cover the main metal shell of spark plugs.

In addition, the chromate coatings including the gold chromate coat share the common problem of being low in heat resistance. In automotive engines, the cylinder head on which the spark plug is mounted is water cooled and the spark plug seldom becomes extremely hot. However, if the engine is continuously run under high thermal load conditions or if the mounting position of the spark plug is fairly close to the exhaust manifold, the temperature of the main metal shell sometimes increases to about 200 to 300° C. In this situation, the chromate coat undergoes accelerated deterioration and its performance in corrosion protection may suddenly drop.

SUMMARY OF THE INVENTION

It is an object of the present invention to provide a spark plug having the surface of the main metal shell coated with a chromate coat that is reduced in the content of hexavalent chromium and which yet exhibits better anti-corrosion performance and higher heat resistance than the conventional chromate coatings.

It is another object of the invention is to provide a method for producing the spark plug.

[Means for Attaining the Objects, Mode of its Action and Resulting Advantages]

According to a first aspect of the present invention, a spark plug comprises a central electrode, an insulator provided outside said central electrode, a main metal shell provided outside said insulator and a ground electrode provided to oppose to said central electrode to define a spark discharge gap, wherein the surface of said main metal shell is coated with a complex chromate coat containing a chromium component and a phosphorus component as cationic components, at least 90 wt % of the chromium component being trivalent chromium and the phosphorus component being present in an amount of 1 to 15 wt % as calculated for $PO_4$.

The "cationic components" as used herein is a term related to a photoelectron spectrum for a coating analyzed by X-ray photoelectron spectroscopy (XPS or ESCA) and means any component of interest (element or atom) that has a chemical shift in the peak of its binding energy toward a positive ionic valence.

In the above spark plug, the surface of the main metal shell is coated with a complex chromate coat that contains a chromium component and a phosphorus component as cationic components, at least 90 wt % of the chromium component being trivalent chromium and the phosphorus component being present in an amount of 1 to 15 wt % as calculated for $PO_4$ . In the ordinary gold chromate coat, about 25 to 35 wt % of the chromium component is hexavalent chromium. However, in the coating of the invention, the content of hexavalent chromium is less than 10 wt % of the chromium component, which is small enough to be of benefit to environmental protection by reducing the emission of hexavalent chromium. The treating bath used to deposit the chromate coating of the invention contains no hexavalent chromium at all or contains only a small amount of it as compared with the treating baths for the gold chromate coat and other conventional chromate coatings. As a result, the problems with effluent treatment are substantially reduced.

The complex chromate coat used in the spark plug is characterized by containing a phosphorus component as a cationic component. The complex chromate coat containing a phosphorus component is markedly improved over the ordinary trivalent chromium based chromate coat in terms of the ability to prevent corrosion, giving the main metal shell of the spark plug adequate durability against corrosion.

If the content of the phosphorus component in the complex chromate coat is less than 1 wt %, the desired performance in corrosion prevention is not attained. Incorporating more than 15 wt % of the phosphorus component is very difficult, since there is a limit on the concentration of the phosphorus component in the treating bath to be used. The content of the phosphorus component in the complex chromate coat is more desirably in the range of 5 to 10 wt %. For the purpose of enhancing the corrosion preventing performance of the complex chromate coat, it is desired that the phosphorus component be mainly contained in the form of phosphate ion ($PO_4^{3-}$).

The complex chromate coat may contain a phosphorus component dispersing chromate layer that has the phosphorus component dispersed in a trivalent chromium based compound in an amount of 2 to 15 wt % as calculated for $PO_4$. The phosphorus component dispersing chromate layer can be easily formed by immersing the main metal shell of a spark plug into a chromating bath containing phosphoric acid or a phosphate. The dispersion of the phosphorus component in the trivalent chromium based compound contributes to a further improvement in the corrosion preventing performance of the complex chromate coat. In this case, the phosphorus component originates from the phosphoric acid or phosphate contained in the chromating bath.

The phosphorus component dispersing chromate layer may independently constitute the whole of the complex chromate coat. In this case, from the viewpoint of ensuring the desired performance in corrosion prevention, the concentration of the phosphorus component in the phosphorus component dispersing chromate layer (i.e., the complex chromate layer) is desirably at least 2 wt % as calculated for $PO_4$. In order to improve the corrosion protecting and heat resisting capabilities, the phosphorus component dispersing chromate layer may be coated with another layer such as a silica based or siliceous layer to be described hereinafter. In this case, the concentration of the phosphorus component throughout the complex chromate coat may be as small as about 1 wt %. On the other hand, due to the limit on the concentration of the phosphorus component in the chromating bath to be used, it is very difficult to form a phosphorus component dispersing chromate layer containing more than 15 wt % of the phosphorus component as calculated for $PO_4$.

According to a second aspect of the present invention, the spark plug comprises a central electrode, an insulator provided outside said central electrode, a main metal shell provided outside said insulator and a ground electrode provided to oppose to said central electrode to define a spark discharge gap, wherein the surface of said main metal shell is coated with a complex chromate coat that contains a chromium component and a silicon component as cationic components, at least 90 wt % of the chromium component being trivalent chromium and the silicon component being present in an amount of 5 to 75 wt % as calculated for $SiO_2$.

In this spark plug, also, the content of hexavalent chromium in the complex chromate coat is less than 10 wt % of the chromium component, which is small enough to be of benefit to environmental protection by reducing the emission of hexavalent chromium. In addition, the problems with effluent treatment are substantially reduced. What is more, due to the inclusion of the silicon component as a cationic component, the complex chromate coat is markedly improved over the ordinary trivalent chromium based chromate coat in terms of the ability to prevent corrosion and withstand heat, allowing the main metal shell of the spark plug to have significantly improved durability against corrosion.

If the content of the silicon component in the complex chromate coat is less than 5 wt %, it becomes difficult to ensure the desired ability to prevent corrosion and withstand heat. If the content of the silicon component exceeds 75 wt %, the relative proportion of the chromate compound decreases and the performance in corrosion protection is impaired rather than improved. Note that the content of the silicon component in the complex chromate coat is more desirably in the range of 10 to 40 wt %.

The complex chromate coat may contain a silicon component dispersing chromate layer that has the silicon component dispersed in a trivalent chromium based compound in an amount of 10 to 40 wt % as calculated for $SiO_2$. The silicon component dispersing chromate layer can be easily formed by immersing the main metal shell of a spark plug into a chromating bath containing an alkali silicate. The dispersion of the silicon component in the trivalent chromium based compound contributes to a further improvement in the ability of the complex chromate coat to prevent corrosion and withstand heat. In this case, the silicon component originaterom the alkali silicate contained in the chromating bath.

The silicon component dispersing chromate layer may independently constitute the whole of the complex chromate coat. In this case, from the viewpoint of ensuring the desired ability to prevent corrosion and withstand heat, the concentration of the silicon component in the silicon component dispersing chromate layer (i.e., the complex chromate layer) is desirably at least 10 wt % as calculated for $SiO_2$. In order to further improve the corrosion protecting and heat resisting capabilities, the silicon component dispersing chromate layer may be coated with another layer (e.g. a resin layer or a siliceous based layer to be described later). If the silicon component dispersing chromate layer is to be coated with a silicon-free layer, the concentration of the silicon component throughout the complex chromate coat may be as small as about 5 wt %. Conversely, if the silicon component dispersing layer is to be coated with a silicon-containing layer (e.g. a silica layer), the concentration of the silicon component throughout the complex chromate coat may be as large as 75 wt %. It should be noted that due to the limit on the concentration of the alkali silicate in the chromating bath to be used, it is very difficult to form a silicon component dispersing chromate layer containing more than 40 wt % of the silicon component as calculated for $SiO_2$.

The phosphorus component dispersing layer and the silicon component dispersing layer may be combined into a complex structure (which may be regarded as containing 10 to 40 wt % of the silicon component in the phosphorus component dispersing chromate layer). In this case, the improvement in corrosion preventing performance achieved by the dispersion of the phosphorus component is combined with the improvement in the ability to prevent corrosion and withstand heat as achieved by the dispersion of the silicon component, so that a complex chromate coat of even better performance is produced.

For the purpose of enhancing the corrosion preventing performance of the complex chromate coat, it is desired that the phosphorus component in the phosphorus component dispersing chromate layer be mainly contained in the form of phosphate ion ($PO_4^{3-}$). For the purpose of enhancing the corrosion preventing and heat resisting capabilities of the complex chromate coat, it is desired that the silicon component be mainly contained in the form of a silicon compound such as silicon dioxide ($SiO_2$). In the present invention, the phosphorus component is assumed to be bonded to oxygen if a phosphorus peak with a valence of +5 or a value close to it and an oxygen peak with a valence of −2 or a value close to it are detected simultaneously in an XPS spectrum. If a silicon peak with a valence of +4 or a value close to it and an oxygen peak with a valence of −2 or a value close to it are detected simultaneously, the silicon component is assumed to be bonded to oxygen.

A chromate coat is formed by the reaction between the substrate or base metal and the solution containing chromate ions. This reaction is said to proceed mainly by the following mechanism: trivalent chromium atoms are connected together by bridges of a hydroxyl group and oxygen to form a polymer to like complex which is precipitated and deposited as a gel on the surface of the substrate metal. If a hydroxyl group binds to tetravalent chromium, the proton in the hydroxyl group causes an apparent shift to +4 in the valence of chromium. In the present specification, the chromium component is assumed to be a constituent of the chromate coat if an XPS spectrum has a peak component with a chemical shift from the peak position for trivalent chromium to a position that generally corresponds to a valence of +4.

Chromating is a kind of chemical conversion treatment in which the chromium component is "substitution" deposited on the substrate metal as the latter is oxidatively dissolved. Therefore, in an electroless chromating method which has no external power supply, the substrate metal must be capable of dissolving into the chromating bath. The main metal shell and the gasket of a spark plug are generally formed of ferrous materials such as carbon steels. In order to protect them from corrosion, their surfaces can be coated with a zinc based plate layer of which the metal component is mostly composed of zinc. The zinc based plate layer can advantageously be used as the substrate for the formation of a chromate coat since it is capable of dissolving into the chromating bath. In this case, the dissolved zinc component is very often incorporated into the chromate coat. The zinc based plate layer can be formed by known electrolytic galvanizing or hot zinc dipping techniques.

If an electrolytic chromating method is adopted, a chromate coat can be formed on a nickel based plate layer of which the metal component is mostly composed of nickel.

In order to ensure the required performance in corrosion protection, the phosphorus component dispersing chromate layer or the silicon component dispersing chromate layer is desirably such that the total weight of the cationic components minus the weight of the phosphorus component or the silicon component is occupied by the chromium component in a total weight of at least 50 wt %. In this case, the cationic components other than the chromium component may be comprised of zinc, nickel, etc.

A siliceous layer based on a silicon oxide may be formed in the surface layer of the complex chromate coat and this helps further enhance its ability to prevent corrosion and withstand heat. As in the case of the phosphorus component dispersing chromate layer and the silicon component dispersing chromate layer, the siliceous layer is desirably such that the total weight of the cationic components is occupied by the silicon component in a total weight of at least 50 wt %, with the balance being composed of other cationic components such as chromium, zinc and nickel.

In order to form the siliceous layer, the main metal shell of a spark plug having a substrate trivalent chromium based chromate layer formed on its surface may be coated with a silicate solution having an alkali silicate dissolved in a suitable solvent which is subsequently evaporated. The resulting siliceous layer is mainly composed of an oxide in which the cationic components are mostly an alkali metal element and silicon. The substrate trivalent chromium based chromate layer is exemplified by the phosphorus component dispersing chromate layer or the silicon component dispersing chromate layer, provided that they may be replaced by a chromate layer that does not contain the phosphorus component or the silicon component in an amount exceeding the lower limits for their inclusion in the phosphorus component dispersing chromate layer or the silicon component dispersing chromate layer, on the condition that the overall complex chromate coat including the siliceous layer contains the silicon component in an amount of 5 to 75 wt %

Alternatively, the siliceous layer may be formed by vapor-phase film deposition techniques such as high frequency sputtering, reactive sputtering, ion plating and chemical vapor deposition (CVD). However, the application of the silicate solution is preferred, since the siliceous layer can be formed by simply immersing the chromated main metal shell (or gasket) in the silicate solution or spraying it with the silicate solution or otherwise applying the solution to form a coat, which is then dried.

Between the substrate trivalent chromium based chromate layer and the siliceous layer, there may be formed a trivalent chromium/silicon dispersing layer which has the trivalent chromium component and the silicon component dispersed in proportions that are smaller than the respective contents in the first two layers. This occasionally contributes to a further improvement in the ability of the complex chromate coat to prevent corrosion or withstand heat. The trivalent chromium/silicon dispersing layer is a kind of compositionally gradient structure that is formed between the trivalent chromium based chromate layer and the siliceous layer and the above-described improvement in the performance of the complex chromate coat can be achieved by several reasons such as betterment of the adhesion between the trivalent chromium based chromate layer and the siliceous layer and relief of the stress due to differential shrinkage of the two layers during heating.

It is generally considered that the gold chromate coat and other existing hexavalent chromium based chromate coatings exhibit satisfactory performance in corrosion protection, since the hexavalent chromium contain therein helps to repair the reticulate structure of trivalent chromium atoms even if the protective coat breaks in a corrosive environment. However, the trivalent chromium based chromate layer does not have this repair effect of the hexavalent chromium. If pin holes and other defects develop in the protective coat, the corrosive action would directly affect the substrate such as the zinc based plate layer to cause rapid progress of the corrosion. However, in the complex chromate coat of the invention having the siliceous layer, the trivalent chromium based chromate layer is "overcoated" with the siliceous layer and the corrosive action would have a long way to go before reaching the surface of the underlying trivalent chromium based chromate layer. Hence, the substrate layer contributes to enhance corrosion protection.

The conventional chromate coatings have only poor heat resistance, because they would shrink with heat to increase the likelihood for the occurrence of defects such as cracks. This is not the case with the complex chromate coat of the invention having the siliceous layer; even if cracks and other defects develop in the trivalent chromium based chromate layer, the overlying heat-resistant siliceous layer would retard the deterioration of the corrosion preventing performance of the complex chromate layer.

In order to form a uniform siliceous layer, it is also important to increase the wettability of the substrate trivalent chromium based chromate layer with the silicate solution. For example, when the substrate trivalent chromium based chromate layer has pin holes, cracks or any other defects (which may be the defects in the substrate that were initially caused by surface flaws, the deposition of foreign matter, etc.), if the silicate solution is not capable of efficient wetting of the substrate trivalent chromium based chromate layer, there is high likelihood for bubbles and other unwanted phenomena to be trapped within the defects. This problem can be effectively solved by using an aqueous silicate solution that contains a suitable amount of surfactant.

There is still another way to form the siliceous layer. After the end of the chromating step, the main metal shell of the spark plug may be dipped in the silicate solution while it remains either yet to be dried or partially dried on the surface. That is, the as-chromated wet or half dry surface of the main metal shell has the slightly moistened substrate trivalent chromium based chromate layer which has good affinity for the aqueous silicate solution which is subsequently applied. Even if defects have been formed in the substrate trivalent chromium based chromate layer, the aqueous silicate solution sufficiently fills the defects that they will not trap any undesirable phenomena such as bubbles and the corrosion preventing performance of the complex chromate coat is improved. As another advantage, the chromating solution remaining on the surface of the substrate trivalent chromium based chromate layer mixes with part of the applied aqueous silicate solution to increase the chance of the formation of the already mentioned trivalent chromium/silicon dispersing layer. We have already explained the advantages of forming the trivalent chromium/silicon dispersing layer.

Some spark plugs have an annular gasket fitted around the basal end portion of the mounting threaded section formed on the peripheral surface of the main metal shell. When the threaded section of the main metal shell is screwed into the threaded hole in the cylinder head, the gasket deforms to be compressed between a gas seal flange formed at the distal end of the threaded section and the peripheral edge of the opening of the threaded hole so as to provide a seal between the threaded hole and the gas seal flange. In this type of spark plug, the surface of the gasket may at least partly be coated with the above-described complex chromate coat of the invention so that not only the main metal shell but also the gasket can be provided with the desired corrosion and heat resisting properties.

If desired, a zinc plate layer as the substrate metal layer may be overlaid with the complex chromate coat of the invention. In a spark plug having this layer arrangement, when subjected to "5. Neutral Salt Spray Test" according to the plate corrosion resistance test procedure specified in JIS H8502, it can withstand for at least 40 hours before at least about 20% of the whole surface is coated with white rust due to corrosion of the zinc plate layer. This is a satisfactory level of corrosion resistance that should be exhibited by the main metal shell of spark plugs.

The problem peculiar to spark plugs is that if the engine is continuously run under high thermal load conditions or if the mounting position of the spark plug is fairly close to the exhaust manifold, the temperature of the main metal shell sometimes increases to about 200 to 300° C. These situations can be effectively dealt with by forming a zinc plate layer as the substrate metal layer and overlying it with the complex chromate coat of the invention and a spark plug having this layer arrangement exhibits satisfactory enduring performance in the following test simulating those situations. Thus, the spark plug is characterized in that when subjected to "5. Neutral Salt Spray Test" according to the plate corrosion resistance test procedure specified in JIS H8502 after heating at 200° C. for 30 minutes in air atmosphere, it can withstand for at least 40 hours before at least about 20% of the whole surface is coated with white rust due to corrosion of the zinc plate layer.

PREFERRED EMBODMENTS OF THE INVENTION

Preferred embodiments of the invention are described below with reference to the accompanying drawings.

Figure 1:
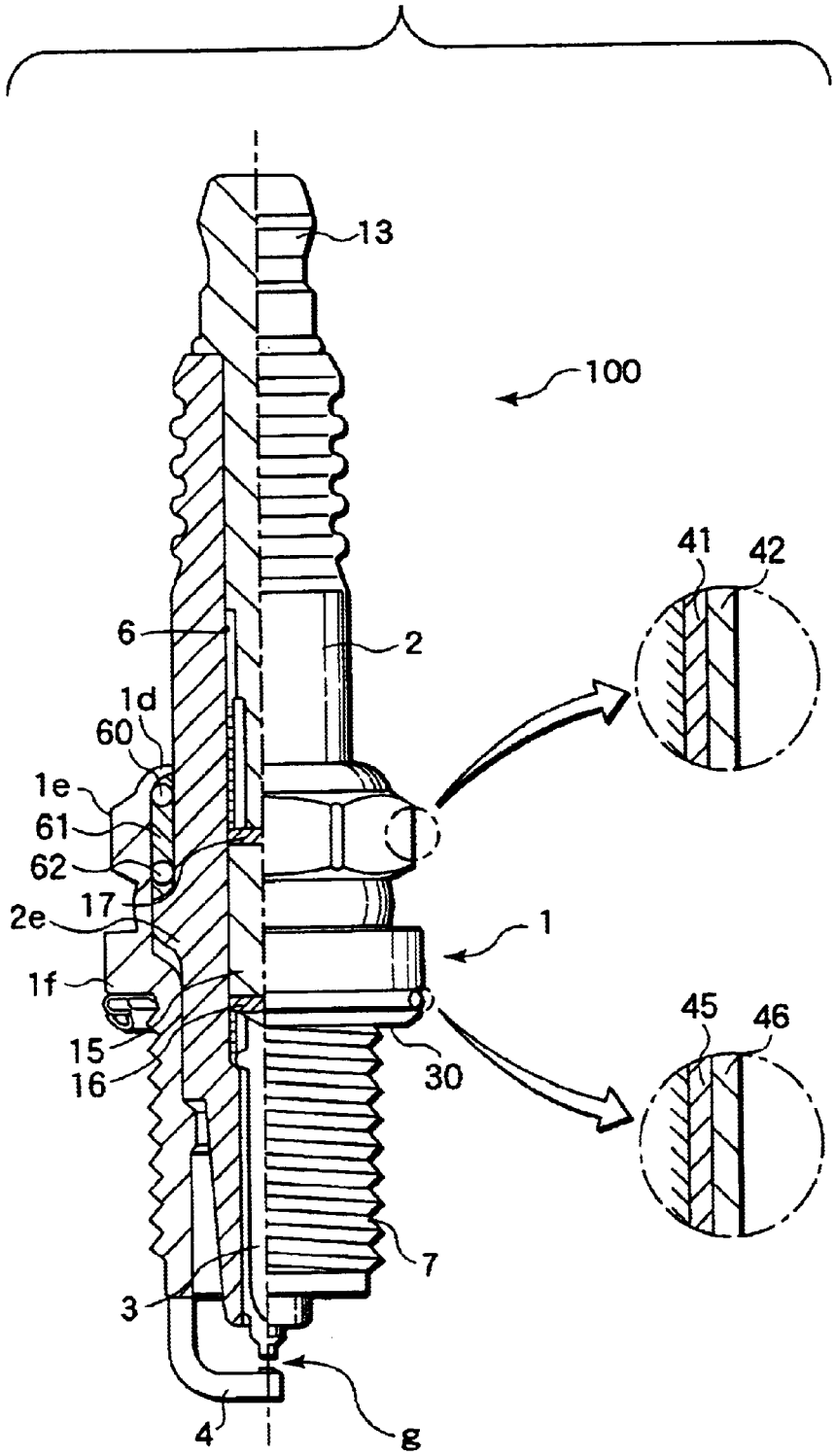
FIG. 1 shows a spark plug according to one embodiment of the present invention, with a longitudinal half in section.

FIG. 1 shows a resistor-loaded spark plug 100 which is an embodiment of the spark plug of the invention. The spark plug 100 is essentially constituted by a tubular main metal shell 1, an insulator 2 fitted into the main metal shell 1 so that the distal end portion projects outwardly, a central electrode 3 provided within the insulator 2 so that the distal end portion projects outwardly, and a ground electrode 4 in which one end is connected to the main metal shell land the other end is opposed to the tip of the central electrode 3. A spark discharge gap g is formed between the ground electrode 4 and the central electrode 3.

The insulator 2 is formed of a sintered ceramics body such as alumina and aluminum nitride. The insulator 2 has a through-hole 6 extending along its axis to accommodate the central electrode 3 when the latter is fitted. A metallic terminal 13 is fitted and fixed in the through-hole 6 at one end portion and the central electrode 3 at the other end portion. A resistor 15 is provided within the through-hole 6 between the metallic terminal 13 and the central electrode 3. The one end of the resistor 15 is electrically connected to the central electrode 3 via a conductive glass seal layer 16 and the other end of the resistor 15 is electrically connected to the metallic terminal 13 via a conductive glass seal layer 17.

The main metal shell 1 is a cylindrical member that is formed of a metal such as a carbon steel and constitutes the housing of the spark plug 100. Threads 7 is formed on the peripheral surface to assist in the mounting of the plug 100 on an engine block (not shown). Reference numeral 1*e* designates a tool engaging portion that engages a tool such as a spanner or a wrench which is applied for mounting the main metal shell 1, and it has a hexagonal axial cross section.

A annular packing wire 62 is provided between the inner surface of the rear opening of the main metal shell 1 and the outer surface of the insulator 2. The annular packing wire 62 engages with the rear peripheral edge of a flange portion 2*e*. Provided rearward of the wire packing 62 is another annular packing wire 60, with a powdery material such as talc being placed between the two wires of packing to form a filling layer 61. In order to fix the main metal shell 1 to the insulator 2, the latter is pushed forward into the main metal shell 1 and the edge of its opening is crimped inward (towards the packing 60) to form a crimped portion 1*d*.

A gasket 30 is fitted around the basal end of the threaded section 7 of the main metal shell 1. The gasket 30 is an annular member that is shaped by bending a sheet stock made of a metal such as a carbon steel. When the threaded section 7 is screwed into the threaded hole in the cylinder head, the gasket 30 deforms to be compressed between the gas seal flange if of the main metal shell 1 and the peripheral edge of the opening of the threaded hole so as to provide a seal between the threaded hole and the threaded section 7.

The entire outer surface of a substrate layer (typically made of a carbon steel) on the main metal shell 1 has a zinc plate layer 41 formed as a zinc based plate layer, the outside of which in turn is coated with a complex chromate coat 42. The outer surface of the gasket 30 has a similar layer arrangement which consists of a zinc plate layer 45 and a complex chromate coat 46. The zinc plate layers 41 and 45 are formed by the same method and so are the complex chromate coats 42 and 46. Therefore, the following discussion is made with the zinc plate layer 41 and the complex chromate coat 42 being taken as typical examples.

The zinc plate layer 41 is formed by a known electrolytic galvanizing technique to a thickness of about 3 to 10 $\mu$m. If the thickness of the zinc plate layer 41 is less than 3 $\mu$m, the desired corrosion resistance may not be ensured. A film thickness in excess of 10 $\mu$m is more than necessary to ensure the desired corrosion resistance and the production cost is increased. As a further problem, cracking will often occur in the plate layer during bending the ground electrode 4 or forming the crimped portion 1*d*.

The complex chromate coat 42 is a trivalent chromium based chromate layer in which the cationic component is mostly a chromium component, at least 90 wt % of which is made of trivalent chromium. This is formed as either one of the following two types:

(1) a phosphorus component dispersing chromate layer: this layer has a phosphorus component dispersed in a trivalent chromium based compound in an amount of 2 to 15 wt % as calculated for $PO_4$. It is preferred that the phosphorus component is mainly contained as phosphate ion.

(2) a silicon component dispersing chromate layer: this layer has a silicon component dispersed in a trivalent chromium based compound in an amount of 10 to 40 wt % as calculated for $SiO_2$. It is preferred that the silicon component is mainly contained as a silicon compound. If desired, the phosphorus component may be contained in an amount of 1 to 15 wt % as calculated for $PO_4$. This contributes to a further improvement in the ability of the complex chromate coat 42 to prevent corrosion.

It should be noted that as much as possible of the chromium component is preferably occupied by trivalent chromium and, more preferably, substantially all of the chromium component is trivalent chromium.

The thickness of the complex chromate coat 42 is preferably in the range of 0.2 to 0.4 $\mu$m. If its thickness is less than 0.2 $\mu$m, the desired corrosion preventing performance may not be obtained at all times. A chromate layer thicker than 0.4 $\mu$m is difficult to obtain by a conversion treatment adapted to the formation of trivalent chromium based chromate coatings.

In order to form the complex chromate coat 42, the main metal shell of a spark plug on which a predetermined thickness of zinc plate layer has been formed by a known electrolytic galvanizing method may be dipped in a chromating solution. The following is an exemplary recipe of the applicable chromating solution (which is commonly called a "colorless" or "blue" chromating solution).

| | |
|---|---|
| Chromic acid anhydride: | 0.1 to 2 g/L |
| Sulfuric acid: | 0.3 to 5 g/L |
| Nitric acid: | 0.5 to 10 g/L |
| Phosphoric acid: | may be added up to about 2 g/L as required. |
| Hydrofluoric acid: | may be added up to about 2 g/L as required. |

Chromic acid anhydride is the source of hexavalent chromium. In the above recipe, it is used in less than half the amount (4 to 10 g/L) in the "gold" chromating solution. Sulfuric acid functions as a reaction promoter and nitric acid as an oxidizer to dissolve the substrate metal. Phosphoric acid helps improve the adhesion of a chromate coat to the substrate metal. Hydrofluoric acid is taken into the chromate coat as anion and fortifies the bridging bonds in the polymer-like complex structure of the coat to increase its strength and its performance in corrosion protection.

The solute as the source of hexavalent chromium may be entirely eliminated to formulate the following recipe (which is commonly called a chromium(III) chromating solution):

| | |
|---|---|
| Potassium chromium sulfate (commonly called "chromium alum"): | 2.5 to 3.5 g/L |
| Sulfuric acid: | 3.5 to 4.5 g/L |
| Hydrofluoric acid: | 1.5 to 2.5 g/L |

By using a recipe containing both a trivalent chromium salt and complexing agents for trivalent chromium, one can form a dense and thick trivalent chromium based chromate layer that is difficult to produce by the common chromating techniques. Details of a chromating solution of this type are given in German Patent Publication DE19638176A1 and here we show just one example of the solution's recipe:

| | |
|---|---|
| Chromium(III) chloride ($CrCl_3.6H_2O$): | 50 g/L |
| Cobalt(II) sulfate ($Co(NO_3)_2$): | 3 g/L |
| Sodium nitrate ($NaNO_3$): | 100 g/L |
| Malonic acid: | 31.2 g/L |

The chromating solutions that can be used in the invention are by no means limited to those set forth above and any recipes may be employed as long as they can produce chromate coats in which the content of trivalent chromium is at least 90 wt % of the total chromium component.

The chromating solution described above is supplemented with 0.1 to 2.0 g/L of phosphoric acid as the source of the phosphorus component and 1.0 to 4.0 g/L of an alkali silicate (e.g. sodium silicate) as the source of the silicon component. An aqueous solution of "water glass" may be used as the silicate. Water glass is represented by the general formula $M_2O.nSiO_2$ (M is an alkali metal element such as sodium or potassium).

For the water glass to be used, n is desirably in the range of from about 2 to about 4. If n is less than 2, gelling hardly occurs and the "water glass" becomes soluble in water, making it impossible to produce a stable coat. If n is greater than 4, hydrolysis of the alkali silicate proceeds so far in the chromating solution that a silicon dioxide gel comes out of solution to form a precipitate, making it impossible for the chromating step to be performed consistently. More desirably, n is in the range of 3 to 4.

Figure 2A:
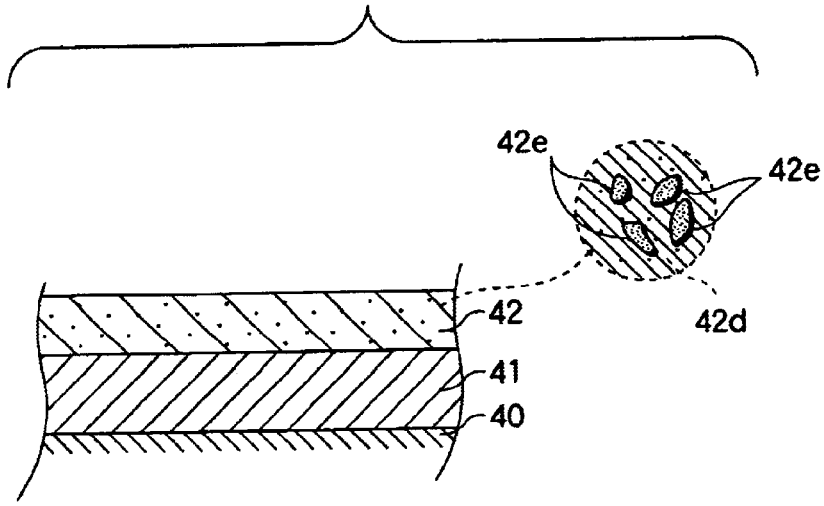
FIGS. 2A and 2B show a structure of a complex chromate coat of the present invention in conceptual form.

The chromating method would generally involve the following reaction. When the galvanized main metal shell of a spark plug is dipped in the chromating solution, zinc dissolves out so as to be replaced by the chromium ion in the solution, which is precipitated as a gel of coat that is based on chromium(III) hydroxide. At the same time, the phosphate ion which provides the phosphorus component or the alkali silicate component is taken into the coat and dispersed therein. For example, in the case of a silicon component dispersing chromate layer; as FIG. 2A shows, it would have a structure having a polymer-like trivalent chromium complex substrate 42*d* that has hardened gels 42*e* dispersed therein which are based on the alkali silicate and silicon dioxide.

Figure 2B:
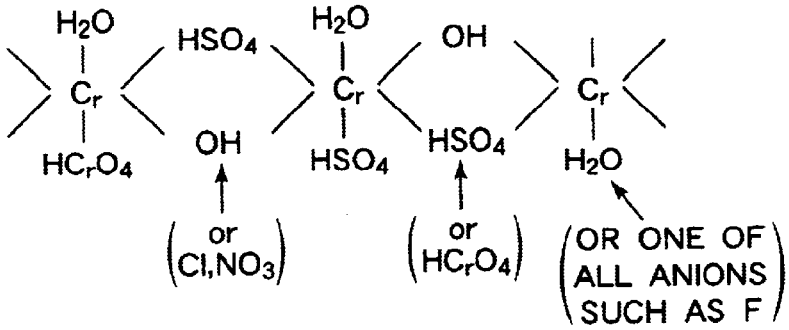

Incidentally, part of the dissolved zinc is also taken into the chromate coat, typically in the form of zinc chromate. The formed chromate coat would probably have the structure shown in FIG. 2B (from which the phosphorus component and the silicon component are omitted). Namely, a polymer-like complex is formed of trivalent chromium atoms that are connected together by hydroxyl or oxygen bridges to give a network structure, which is partly replaced by at least one anion selected from among a chromate, dichromate, sulfate, chloride, fluoride and so forth (the anion to be substituted varies with the formulation of the chromating solution used). The thickness of the chromate layer to be formed can be adjusted by controlling various parameters including the time period for which the main metal shell of the spark plug is to be immersed in the chromating solution, the temperature of the solution and its pH.

The thus treated main metal shell 1 or gasket 30 has the complex chromate coat 42 or 46 formed on the zinc plate layer and this coat has a much higher capability for preventing corrosion or withstanding heat than the conventional trivalent chromium based coatings and even better than the gold chromate coat, thus ensuring that the zinc plate layer exhibits adequate durability against corrosion.

Figure 3A:
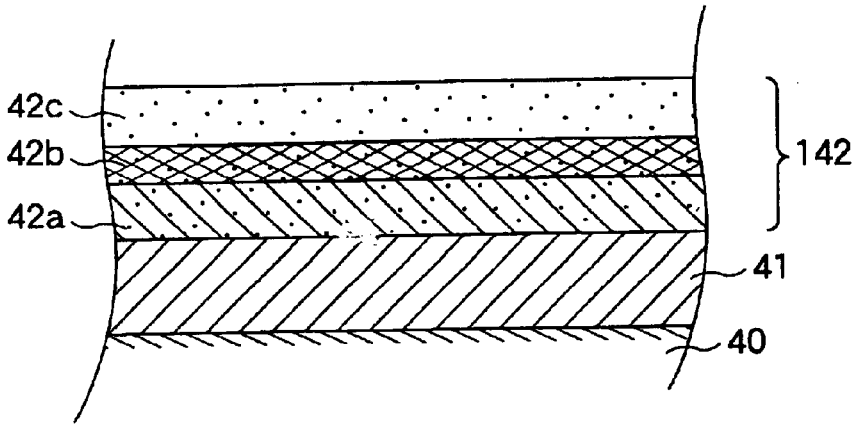
FIGS. 3A and 3B show in conceptual form the structure of a complex chromate coat having a siliceous layer.

As FIG. 3A shows, the substrate trivalent chromium based chromate layer 42*a* (hereunder sometimes referred to as the chromate(III) layer 42*a*) of which the cationic component is mostly the chromium component, at least 90 wt % of which is composed of trivalent chromium, may be coated with a siliceous layer 42*c* that is chiefly composed of a silicon oxide. If the siliceous layer 42*c* is to be formed, it combines with the substrate trivalent chromium based chromate layer 42*a* to make the complex chromate coat 142. In this case, the complex chromate coat 142 taken as a whole contains the silicon component in an amount of 5 to 75 wt %. A trivalent chromium/silicon dispersing layer 42*b* is formed between the layers 42*a* and 42*c*, in which the trivalent chromium component and the silicon component are dispersed in amounts smaller than those present in the respective layers 42*a* and 42*c*.

The chromate(III) layer 42*a* may be the ordinary trivalent chromium based chromate coat that does not contain the phosphorus component or the silicon component. Alternatively, the above-described phosphorus component dispersing chromate layer or silicon component dispersing chromate layer is preferred, since they contribute to a further improvement in the corrosion protection and/or heat resistance properties. The phosphorus component dispersing chromate layer achieves more effective corrosion protection than the silicon component dispersing chromate layer, while its slight inferiority in heat resistance, can be more than compensated by the siliceous layer to realize a complex chromate layer that has an even better balance between corrosion protection and heat resistance.

The total thickness of the complex chromate coat 142 may be within the range of 0.8 to 1.5 $\mu$m. If the total thickness of the chromate coat is less than 0.8 $\mu$m, the zinc plate layer 41 may not be provided with the desired ability to prevent corrosion and withstand heat. A coat thickness in excess of 1.5 $\mu$m is excessive to ensure the desired corrosion resistance and the production cost is increased. As a further problem, delamination of the complex chromate coat 142 may sometimes occur.

The thickness of the chromate(III) layer 42*a* is preferably within the range of 0.2 to 0.4 $\mu$m. If the thickness of the chromate(III) layer is less than 0.2 $\mu$m, the complex chromate coat 142 may sometimes have only inadequate ability to prevent corrosion. If a chromate(III) layer thicker than 0.4 $\mu$m is formed, hexavalent chromium is more likely to be trapped in the layer, occasionally causing a failure to give the desired composition to the chromate(III) layer 42*a*. The thickness of the siliceous layer 42*c* is preferably in the range of 0.2 to 0.8 $\mu$m. If the thickness of the siliceous layer is less than 0.2 $\mu$m, the complex chromate coat 142 sometimes fails to have the desired ability to prevent corrosion and withstand heat. A coat thickness in excess of 0.8 $\mu$m is excessive to ensure the desired corrosion resistance and the production cost is increased. As a further problem, delamination of the coat may sometimes occur.

Figure 4B:
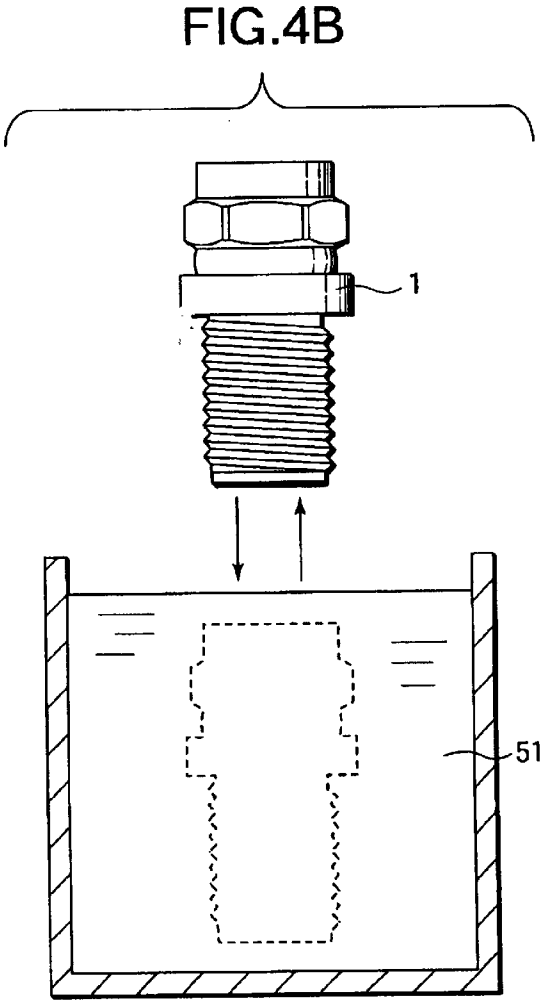
FIG. 4B shows a step of forming the siliceous layer.
Figure 4A:
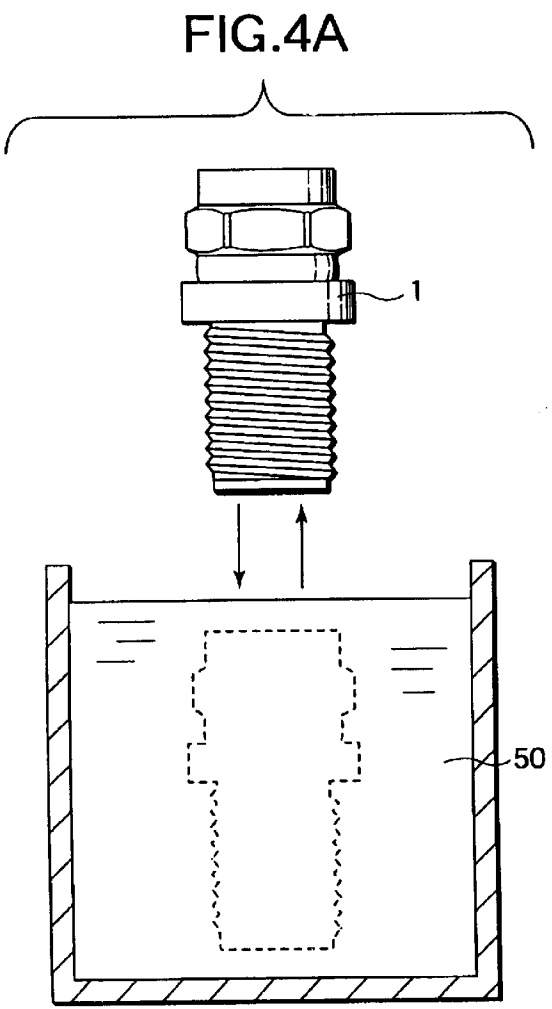
FIG. 4A shows a chromating step.
Figure 5A:
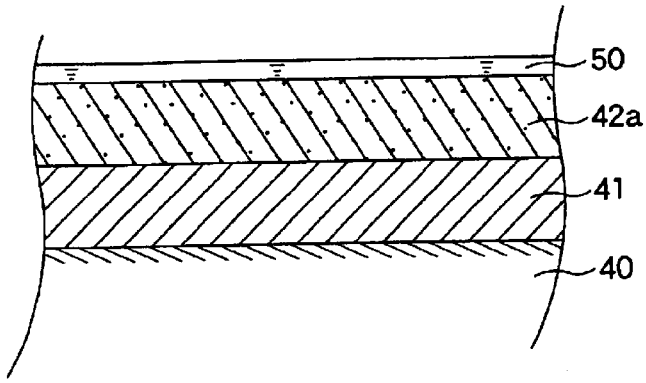
FIGS. 5A to 5C show a method of forming the complex chromate coat by the steps shown in FIGS. 4A and 4B, as well as a hypothetical structure of the chromate layer.

FIGS. 4A and 4B are schematic representations of a method of forming the complex chromate coat 142. In the first step, the main metal shell 1 of a spark plug having a predetermined thickness of zinc plate layer formed by a known electrolytic galvanizing technique or the like is dipped in a chromating solution 50 (FIG. 4A). This causes the chromate(III) layer 42*a* to be formed on the surface of the zinc plate layer 41 on the main metal shell 1 as shown in FIG. 5A. While the chromating solution 50 is formulated according to the recipe set forth above, the ordinary trivalent chromium based chromate coat is formed if neither phosphoric acid nor a silicate is incorporated in the chromating solution.

Figure 5B:
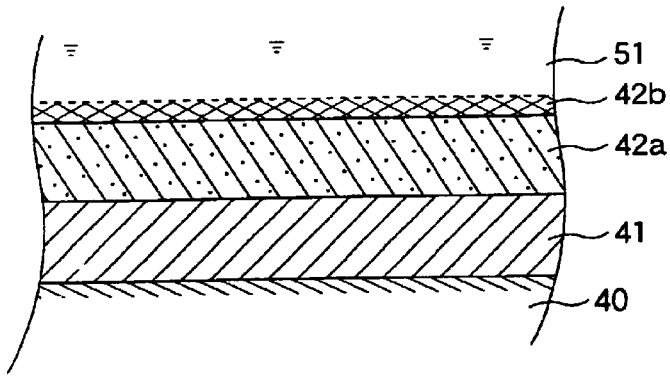
Figure 5C:
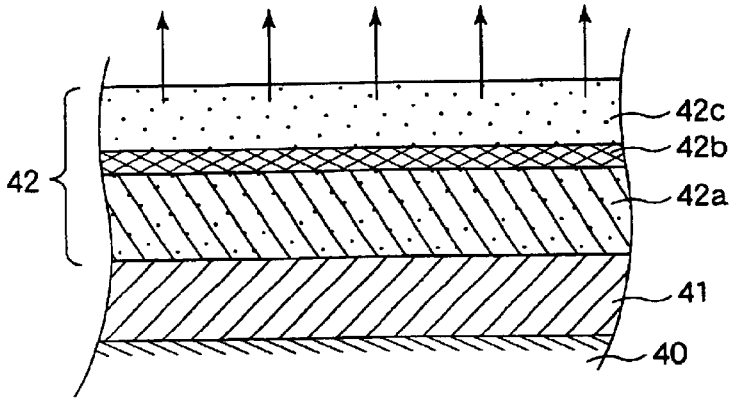

Then, as shown in FIG. 4B, the main metal shell 1 with the chromate(III) layer 42*a* on its surface is dipped in an aqueous silicate solution 51 as it remains wet or half dry. By subsequent drying, the trivalent chromium/silicon dispersing layer 42*b* and the siliceous layer 42*c* are formed as shown in FIG. 5C.

An aqueous solution of water glass can be used as the aqueous silicate solution 51. As already mentioned, the water glass to be used is of such a type that n ranges from about 2 to about 4. Assume here that the complex chromate coat 42 taken as a whole contains the alkali metal M in an amount of $\mu 1$ as calculated for $M_2O$ and the silicon component in an amount of $\mu 2$ as calculated for $SiO_2$; then, the value of $\mu 2/\mu 1$ is preferably adjusted to lie within the range of 2 to 4, more preferably 3 to 4.

In order to ensure that the siliceous layer 42*c* formed on the chromate(III) layer 42*a* is as uniform as possible, the concentration of the alkali silicate in the aqueous silicate solution 51 is preferably adjusted to lie within the range of 30 to 200 g/L. If the concentration of the alkali silicate is less than 30 g/L, the siliceous layer 42*c* formed is not thick enough to ensure that the complex chromate coat 142 always has the desired ability to prevent corrosion or withstand heat. If the concentration of the alkali silicate exceeds 200 g/L, the aqueous silicate solution 51 becomes so viscous that troubles such as uneven application will occur to introduce difficulty in forming a uniform siliceous layer.

As FIG. 5A shows, immediately after the main metal shell 1 is recovered from the chromating solution 50, the latter still remains on the surface of the chromate(III) layer 42*a*. If the main metal shell 1 is immediately dipped in the aqueous silicate solution 51, the chromating solution 50 mixes with part of the applied aqueous silicate solution 51 to form a mixed layer 42*b*' as shown in FIG. 5B. Upon drying, the trivalent chromium/silicon dispersing layer 42*b* deriving from the mixed layer 42*b*' is formed between the chromate (III) layer 42*a* and the siliceous layer 42*c* as shown in FIG. 5C. Since the trivalent chromium/silicon dispersing layer 42*b* is the result of mixing the chromating solution 50 and the aqueous silicate solution 51 (or diffusion of the aqueous silicate solution 51 into the chromate(III) layer 42*a*), the trivalent chromium component and the silicon component will be dispersed in that layer in proportions smaller than those present in the layers 42*a* and 42*c*. This means that the trivalent chromium/silicon dispersing layer 42*b* forms a kind of compositionally gradient structure between the chromate (III) layer 42*a* and the siliceous layer 42*c* to bring about marked advantages such as betterment of the adhesion between the two layers 42*a* and 42*c* and relief of the stress due to their differential shrinkage. Sometimes the trivalent chromium/silicon dispersing layer 42*b* reaches the surface of the complex chromate coat 142 and no distinct siliceous layer is formed. The trivalent chromium/silicon dispersing layer 42*b* may even spread towards the zinc plate layer 41 so that not only the siliceous layer but also the silicon-free chromate(III) layer 42*a* becomes indistinct. In an extreme case, the complex chromate coat 142 is entirely occupied by the single trivalent chromium/silicon dispersing layer 42*b* and yet a kind of compositionally gradient structure is formed having more of the silicon component in the surface layer of the complex chromate coat 142 than in the area closer to the zinc plate layer 41.

Figure 6A:
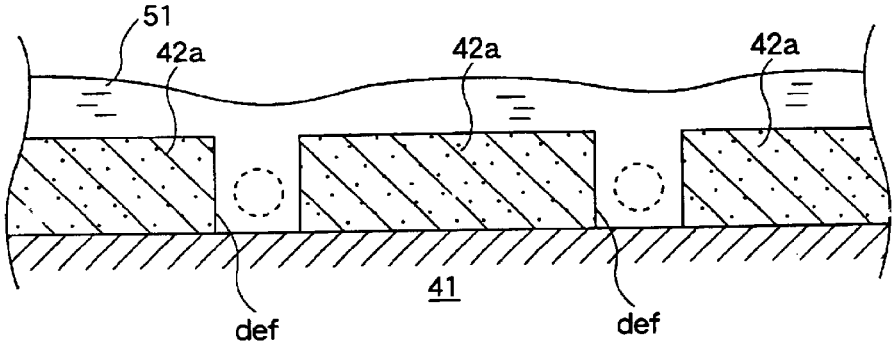
FIGS. 6A and 6B illustrate the advantage of the method of forming the siliceous layer while the previously applied chromate coat remains wet.
Figure 6B:
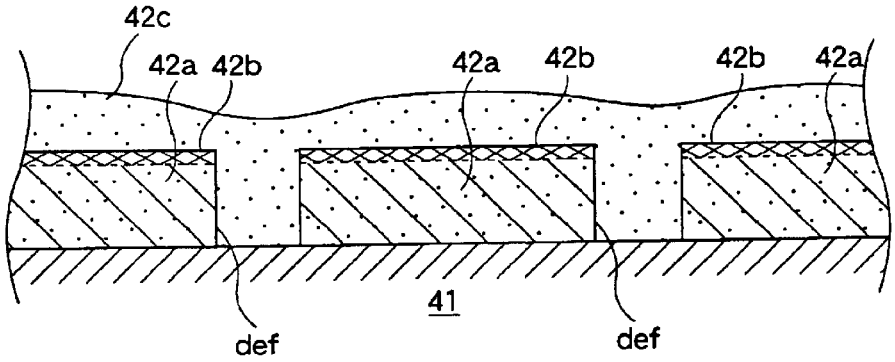

After the completion of the chromating step, the surface of the main metal shell 1 remains either wet or partially dried, so it has the chromate(III) layer 42*a* in a still moist condition and provides good affinity for the aqueous silicate solution 51. Therefore, even if pin holes or other defects which are indicated by def in FIG. 6A develop in the chromate(III) layer 42*a*, the aqueous silicate solution 51 will find it easy to fill those defects sufficiently that no unwanted phenomena such as bubbles are likely to be trapped within the eventually formed siliceous layer 42*c* (see FIG. 6B).

Figure 3B:
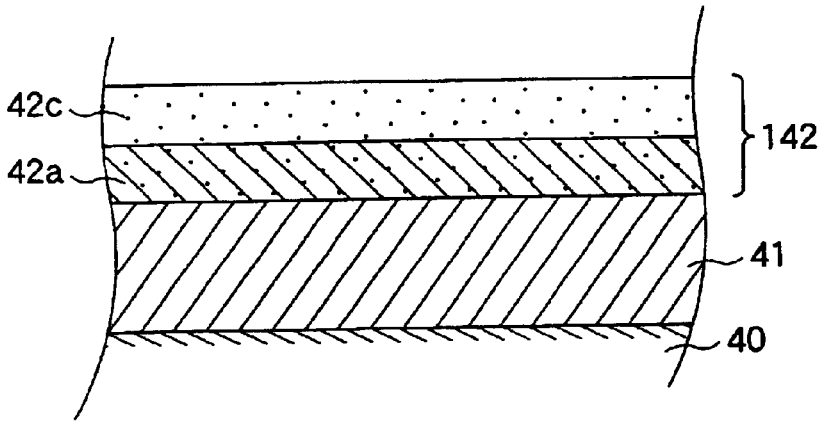

If desired, the surface of the chromated main metal shell 1 may be dried before it is dipped in the aqueous silicate solution 51. In this alternative case, the chromate(III) layer 42*a* is dried before dipping into the aqueous silicate solution 51, so the mixed layer 42*b*' is not easy to result from the mixing of the chromating solution 50 and the aqueous silicate solution 51. In other words, no distinct trivalent chromium/silicon dispersing layer may be formed between the chromate(III) layer 42*a* and the siliceous layer 42*c* as shown in FIG. 3B.

EXAMPLES

Example 1

A wire for cold heading and cold forging (SECH8A) defined by JISG3539 was used as a raw material so as to produce the main metal shell 1 having the shape shown in FIG. 1. The threaded section 7 of the main metal shell 1 had a nominal diameter of 14 mm and an axial length of about 19 mm. A zinc plate layer about 6 μm thick was applied to the main metal shell by electrolytic galvanization using a known alkali cyanide bath.

The chromating solution 50 shown in FIG. 4A was prepared by first dissolving potassium chromium sulfate (3 g/L), nitric acid (4 g/L) and hydrofluoric acid (2 g/L) in deionized water and then incorporating phosphoric acid and water glass ($Na_2O.3.5SiO_2$) in respective amounts of 0.1 to 1.0 g/L and 1.0 to 3.5 g/L. The prepared formulations were held at 20° C. In a separate step, water glass ($Na_2O.3.5SiO_2$) was dissolved in deionized water at a concentration of 100 q/L to prepare the aqueous silicate solution 51 shown in FIG. 4B.

Thus produced galvanized main metal shell samples were dipped in the formulations of chromating solution 50 for 15 seconds, recovered, drained and dried with warm air at 80° C. to form complex chromate coats (see sample Nos. 2 to 11 in Table 1). After drying the chromate coats, sample Nos. 5 and 10 were dipped in the aqueous silicate solution 51, recovered and dried with warm air at 80° C. to form a siliceous layer. Two comparative samples were also prepared, one of which used a chromating solution containing neither phosphoric acid nor water glass (sample No. 1) and the other having no chromate coat but having a siliceous layer (sample No. 12). An additional sample No. 13 of the invention was prepared by dipping the galvanized main metal shell for 15 seconds in a chromating solution 51 of the same formulation as used in preparing sample No. 5, recovering the main metal shell, draining it, immediately dipping it into the aqueous silicate solution 51 without drying, recovering it and drying it with hot air at 80° C.

The complex chromate coat of sample No. 5 was subjected to XPS as it was etched in the direction of thickness. According to the XPS spectra obtained, the cationic components in the complex chromate coat were mostly chromium and zinc was the second element of abundance. A further investigation of the chromium peak ($2p_{2/3}$) showed that 99 wt % or more of the chromium component was composed of trivalent chromium. As for sample Nos. 1 to 4, 6 to 9 and 11 which had no siliceous coat, the compositions of the complex chromate coats were analyzed by the combination of XPS and X-ray fluorescence spectrometry. As a result, they were found to contain the phosphorus and silicon components at the concentrations shown in Table 1. In the XPS spectra, the phosphorus and silicon peaks had chemical shifts toward positive valences and oxygen was also detected. Therefore, it was speculated that the phosphorus and silicon components occurred in the form of a phosphate ion and a silicon oxide (probably $SiO_2$), respectively. The thicknesses of the complex chromate coats were determined by actual measurement from SEM sections and found to be within the range of from about 0.25 μm to about 0.30 μm.

Sample Nos. 5 and 10 having a siliceous layer were subjected to both XPS with etching in the direction of thickness and X-ray fluorescence spectrometry; as a result, the siliceous layer was found to be an oxide based coat containing silicon and sodium in respective amounts of 77 wt % and 22 wt % as calculated for $SiO_2$ and $Na_2O$. The thickness of the siliceous layer was determined by actual measurement from SEM sections and found to be about 0.7 μm.

Figure 7:
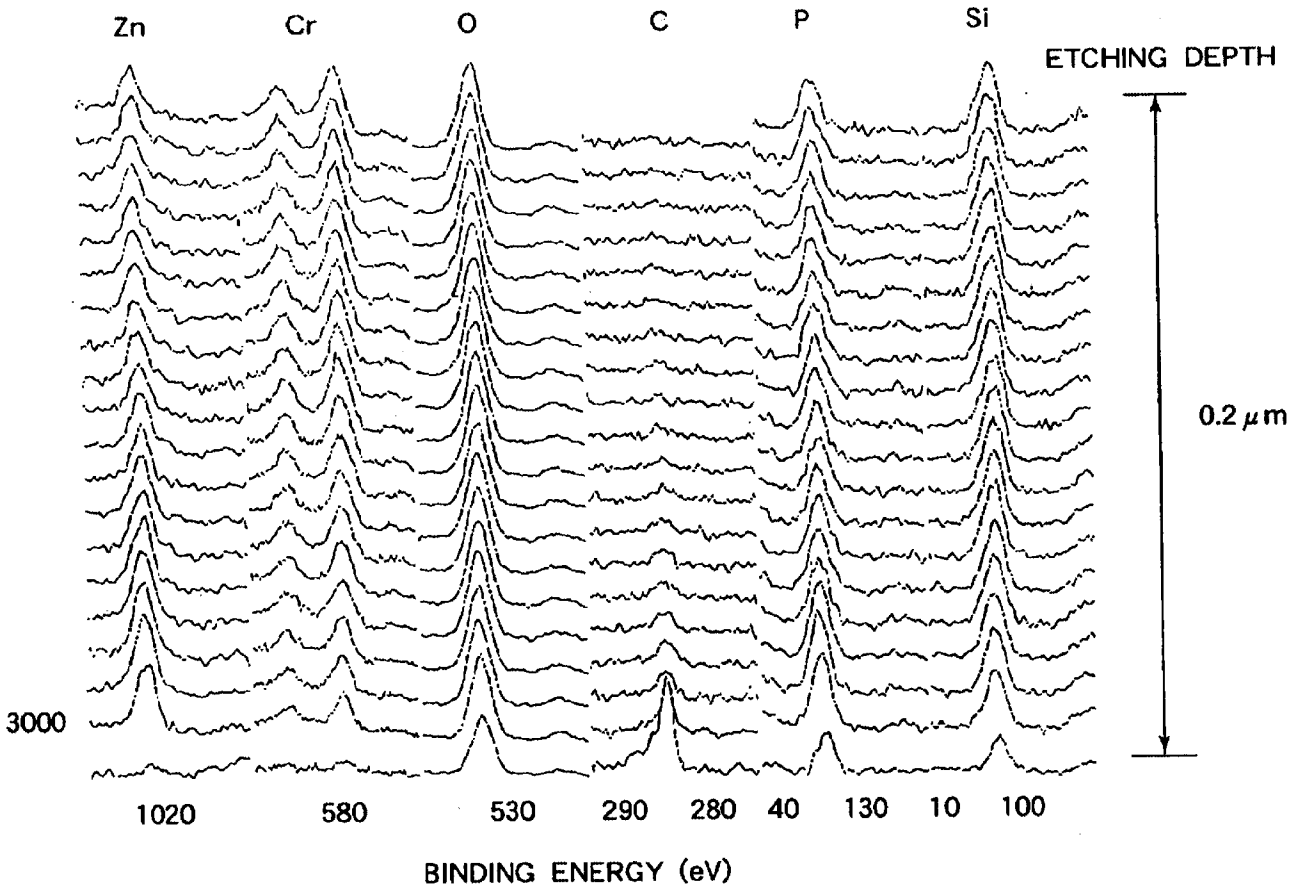
FIG. 7 shows the result of XPS analysis of the complex chromate coat formed on sample No. 13 in Example 1.

Sample No. 13 was subjected to XPS as the complex chromate coat was etched in the direction of thickness and the XPS spectra obtained are shown in FIG. 7. The spectrum peak intensities for the various components at the respective etching depths indicated the presence of a chromate layer having a compositionally gradient structure in which the concentration of the silicon component gradually decreased as the depth from the surface increased. The contents of the phosphorus and silicon components throughout the complex chromate coat were measured by the combination of XPS and X-ray fluorescence spectrometry and found to be 8 wt % and 14 wt % as calculated for $PO_4$ and $SiO_2$, respectively.

To evaluate their durability, all samples were subjected to a salt spray test in accordance with JIS Z2371 and the time required for at least about 20% of the whole surface to be covered by white rust due to the corrosion of the zinc plate layer or the time required for any evidence of red rust due to the corrosion of the substrate iron layer to be visually observed was measured. The results are shown in Table 1.

TABLE 1

| No. | Phosphoric acid (g/L) | Water glass (g/L) | Phosphorus in coat (wt % cal'd for $PO_3$) | Silicon in coat (wt % cal'd for $SiO_2$) | Thickness of siliceous coat ($\mu$m) | Withstand time (h) in salt spray test (before heating) | Withstand time (h) in salt spray test (after heating) |
|---|---|---|---|---|---|---|---|
| 1* | 0 | 0 | 0 | 0 | — | 30 | 30 |
| 2 | 0.1 | 0 | 1 | 0 | — | 100 | 80 |
| 3 | 0.5 | 0 | 5 | 0 | — | 120 | 100 |
| 4 | 1.0 | 0 | 10 | 0 | — | 180 | 160 |
| 5 | 1.0 | 0 | 10 | 0 | 0.7 | 480 | 360 |
| 6 | 0 | 1 | 0 | 10 | — | 100 | 80 |
| 7 | 0 | 2 | 0 | 20 | — | 140 | 120 |
| 8 | 0 | 3 | 0 | 30 | — | 180 | 160 |
| 9 | 0 | 3.5 | 0 | 35 | — | 200 | 180 |
| 10 | 0 | 2 | 0 | 20 | 0.7 | 480 | 360 |
| 11 | 0.5 | 1 | 5 | 10 | — | 160 | 140 |
| 12* | — | — | No chromate | No chromate | 0.7 | 30 | 30 |
| 13 | 1.0 | 0 | 10 | 0 | 0.7 | 480 | 360 |

Note: The samples with an asterisk (*) were outside the scope of the invention.

Sample No. 13 used the same chromating solution as sample No. 5 and the siliceous coat was formed while the applied chromate coat remained wet.

Obviously, the samples of the invention having the complex chromate coats formed on the surface of the metal plug were much more durable than the comparative samples. Duplicates of these samples were prepared, heated at 200° C. for 30 minutes in air atmosphere and subjected to the same salt spray test. The results are also shown in Table 1. The samples of the invention, particularly sample Nos. 6 to 9 and 11 which had the silicon component dispersed in the chromate coat and sample Nos. 5, 10 and 13 which had the siliceous coat, exhibited outstanding durability.

Example 2

A wire for cold heading and cold forging (SECH8A) defined by JISG3539 was used as a raw material so as to produce the main metal shell 1 having the shape shown in FIG. 1. The threaded section 7 of the main metal shell 1 had a nominal diameter of 14 mm and an axial length of about 19 mm. A zinc plate layer about 6 $\mu$m thick was applied to the main metal shell by electrolytic galvanization using a known alkali cyanide bath.

The chromating solution 50 shown in FIG. 4A was prepared by dissolving potassium chromium sulfate (3 g/L), nitric acid (4 g/L) and hydrofluoric acid (2 g/L) in deionized water and held at 20° C. In a separate step, water glass ($Na_2O.3.5SiO_2$) was dissolved in deionized water at a concentration of 100 g/L to prepare the aqueous silicate solution 51 shown in FIG. 4B. The galvanized main metal shell sample was dipped in the chromating solution 50 for 15 seconds, recovered, drained, immediately dipped into the aqueous silicate solution 51 without drying, recovered and dried with hot air at 80° C. to form a complex chromate coat (sample C of the invention).

Figure 8:
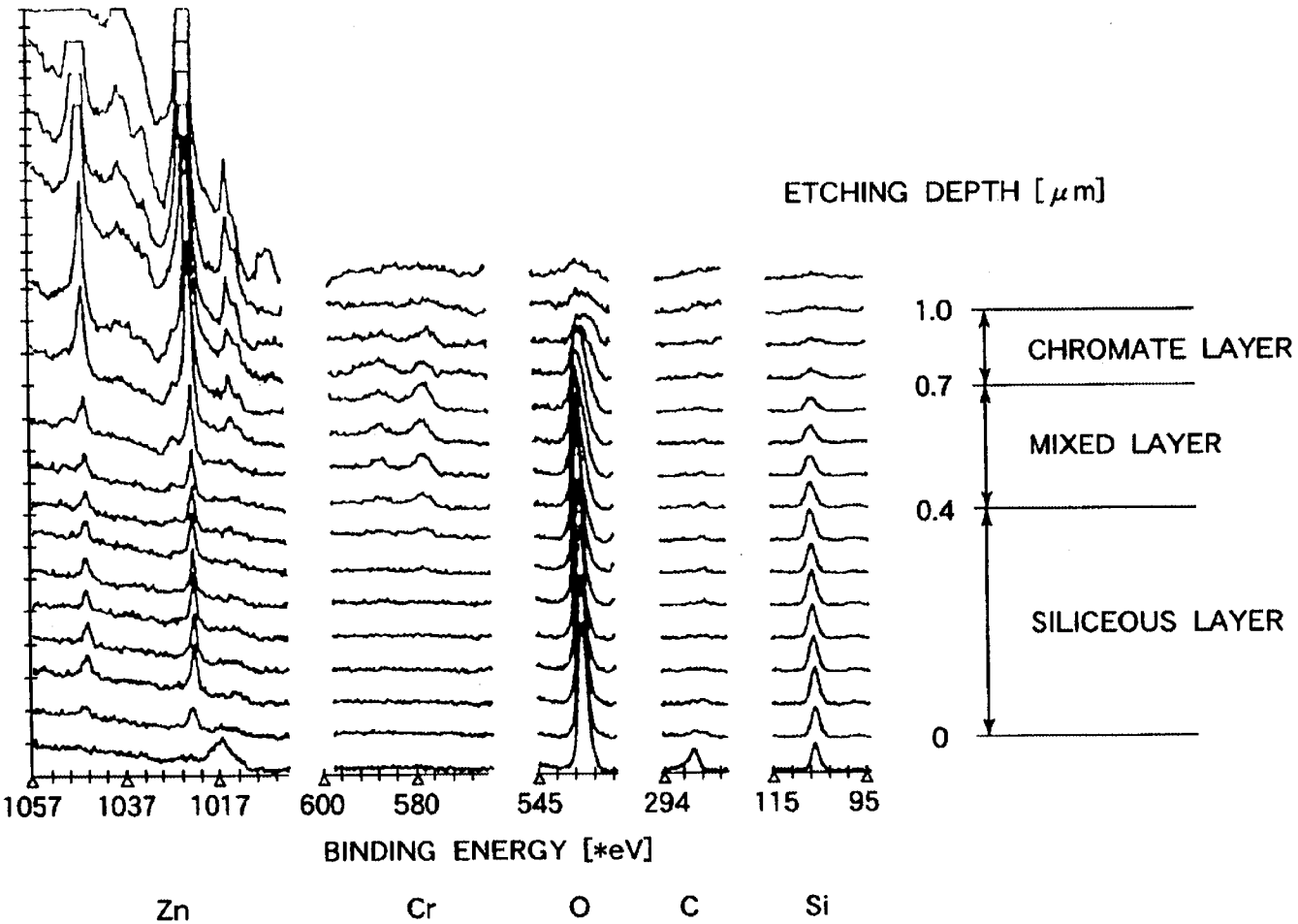
FIG. 8 shows the result of XPS analysis of the complex chromate coat formed on sample C in Example 2.

The complex chromate coat was subjected to XPS as it was etched in the direction of thickness and the XPS spectra obtained are shown in FIG. 8. As one can see from the spectrum peak intensities for the various components at the respective etching depths, the chromium peak ($2P_{2/3}$) was hardly detected in the area ranging from the surface to a depth of about 0.4 $\mu$m, thereby indicating the presence of a siliceous layer mostly composed of a silicon oxide. A further investigation of the siliceous layer by X-ray fluorescence spectrometry showed that it contained silicon and sodium in respective amounts of about 77 wt % and about 22 wt % as calculated for $SiO_2$ and $Na_2O$.

In the area ranging from 0.7 to 1.0 $\mu$m below the surface, small silicon peaks were observed but the cationic components were mostly chromium and zinc was the second element of abundance. A further investigation of the chromium peak ($2p_{2/3}$) showed that 99 wt % or more of the chromium component was composed of trivalent chromium. It was therefore clear that the investigated area which was about 0.3 $\mu$m thick consisted of a trivalent chromium based layer.

The XPS spectrum peak intensities for the various components also showed that the area about 0.3 $\mu$m thick which was located between the siliceous layer and the chromate layer consisted of a trivalent/silicon dispersing layer which contained the chromium and silicon components in proportions smaller than those present in the siliceous and chromate layers. A depth profiling of the XPS spectra showed that the overall complex chromate coat contained the silicon component in an amount of 8 wt %.

Two comparative samples B and D were also prepared. To prepare comparative sample B, the galvanized main metal shell was dipped in the chromating solution 50 for 15 seconds, recovered and immediately dried without being dipped in the aqueous silicate solution 51. To prepare comparative sample D, the galvanized main metal shell was dipped in the aqueous silicate solution 51 rather than in the chromating solution 50, recovered and dried. Analysis by XPS and x-ray fluorescence spectrometry showed the following: comparative sample B had a chromate coat about 0.5 $\mu$m thick having a trivalent chromium content of almost 99 wt % and above in the chromium component whereas comparative sample D had an oxide based coat containing silicon and sodium in respective amounts of 77 wt % and 22 wt % as calculated for $SiO_2$ and $Na_2O$.

On the other hand, a gold chromating solution was prepared by dissolving chromic acid anhydride (7 g/L), sulfuric acid (3 g/L) and nitric acid (3 g/L) in deionized water and held at 20° C. The main metal shell of a spark plug was dipped in the gold chromating solution for about 15 seconds, recovered and dried to prepare another comparative sample A. XPS analysis of the resulting coat showed that it was a chromate coat about 0.5 $\mu$m thick that had a hexavalent chromium content of about 30 wt % in the chromium component, with the balance being trivalent chromium.

Figure 9:
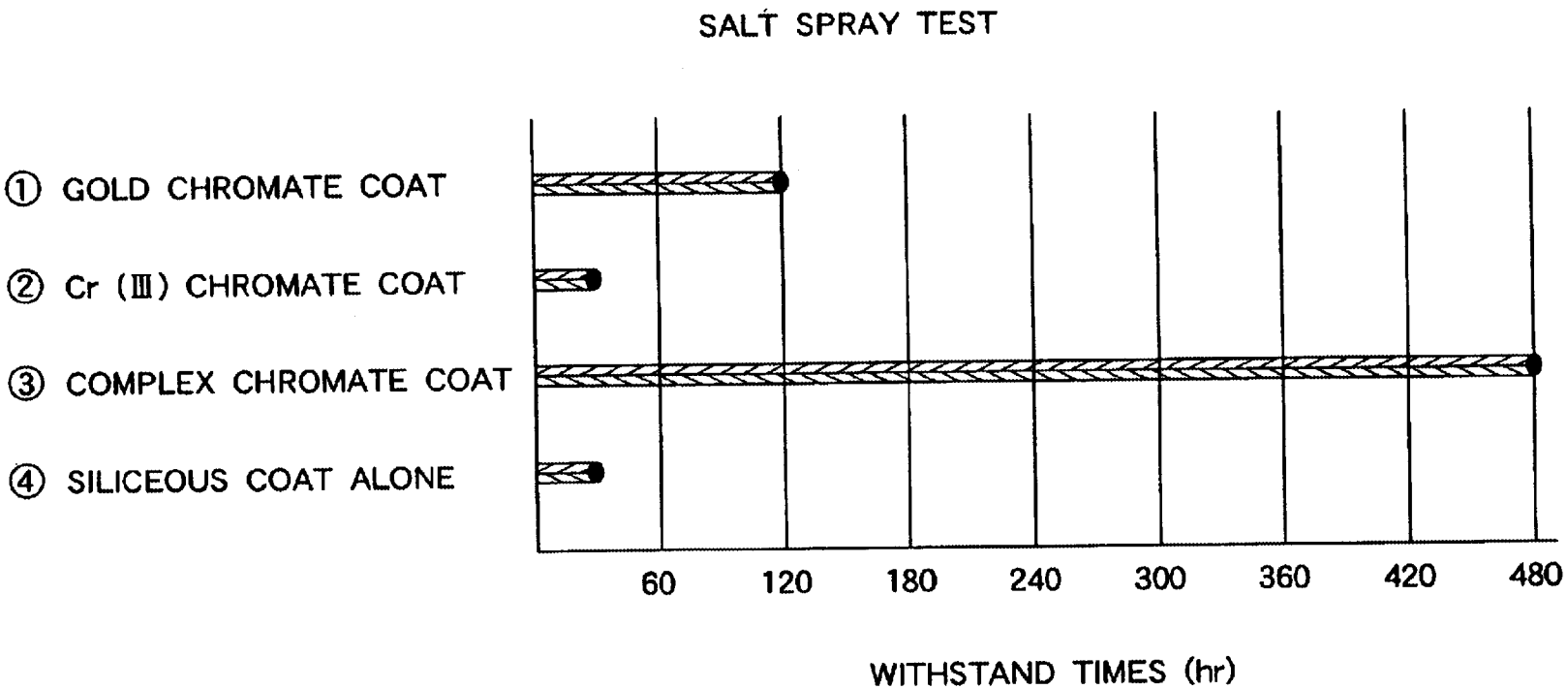
FIG. 9 is a graph showing the result of the salt spray test conducted (before heating) on the four samples prepared in Example 2.

To evaluate their durability, samples A to D were subjected to a salt spray test in accordance with JIS Z2371 and the time required for at least about 20% of the whole surface to be covered by white rust due to the corrosion of the zinc plate layer or the time required for any evidence of red rust due to the corrosion of the substrate iron layer to be visually observed was measured. The results are shown in FIG. 9. Obviously, sample C of the invention having the complex chromate coat formed on the surface of the metal plug was much more durable than all comparative samples including sample A having the gold chromate coat. The results with samples B and D show that no satisfactory durability was obtained when the protective coat was solely comprised of a tetravalent chromium based chromate layer or a siliceous layer.

Figure 10:
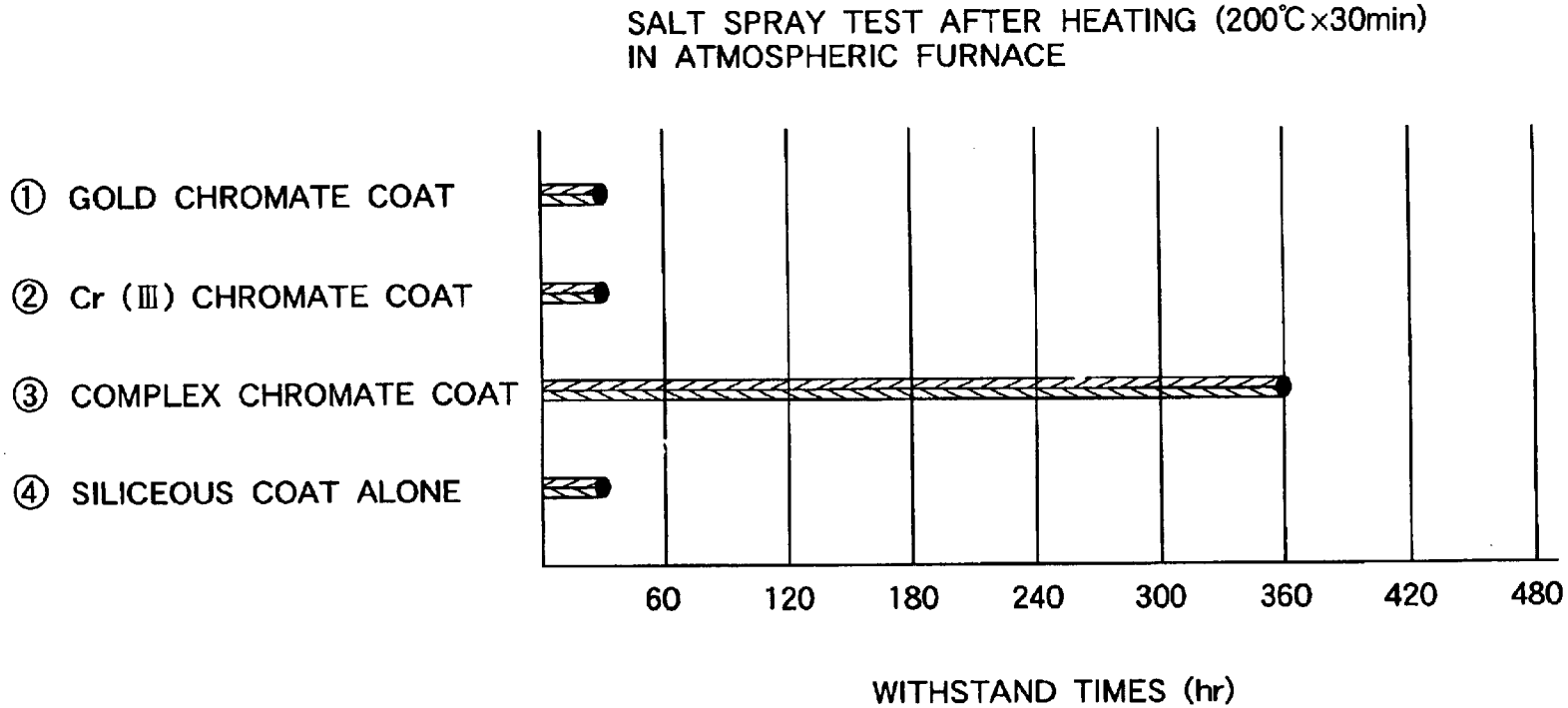
FIG. 10 is a graph showing the result of the salt spray test conducted (after heating) on the four samples prepared in Example 2.

Duplicates of samples A to D were prepared, heated at 200° C. for 30 minutes in air atmosphere and subjected to the same salt spray test. The results are shown in FIG. 10. The withstand time of sample A having the gold chromate coat had decreased considerably upon heating but the durability of sample C of the invention was quite satisfactory.

What is claimed is:

1. A spark plug comprising:

a central electrode;

an insulator provided outside said central electrode;

a main metal shell provided outside said insulator; and a ground electrode provided to oppose to said central electrode to define a spark discharge gap;

wherein a surface of said main metal shell is coated with a complex chromate coat that contains a chromium component comprising at least 90 wt % of trivalent chromium and at least one component of a phosphorus component in an amount of 1 to 15 wt % as calculated for $PO_4$ and a silicon component in an amount of 5 to 75 wt % as calculated for $SiO_2$ as cationic components.

2. The spark plug according to claim 1, wherein the surface of said main metal shell is coated with the complex chromate coat that contains the chromium component comprising at least 90 wt % of trivalent chromium and the phosphorus component in an amount of 1 to 15 wt % as calculated for $PO_4$.

3. The spark plug according to claim 1, wherein said complex chromate coat contains a phosphorus component dispersing chromate layer in which the phosphorus component is dispersed in a trivalent chromium based compound, said phosphorus component being present in an amount of 2 to 15 wt % as calculated for $PO_4$.

4. The spark plug according to claim 1, wherein the chromium component comprising at least 90 wt % of trivalent chromium and the phosphorus component in an amount of 5 to 10 wt % as calculated for $PO_4$.

5. The spark plug according to claim 1, wherein the surface of said main metal shell is coated with the complex chromate coat that contains the chromium component comprising at least 90 wt % of trivalent chromium and the silicon component in an amount of 5 to 75 wt % as calculated for $SiO_2$ as cationic components.

6. The spark plug according to claim 3, wherein said complex chromate coat contains a silicon component dispersing chromate layer having such a structure that the silicon component is dispersed in a trivalent chromium based compound, said silicon component being present in an amount of 10 to 40 wt % as calculated for $SiO_2$.

7. The spark plug according to claim 4, wherein said silicon component dispersing chromate layer contains the phosphorus component in an amount of 1 to 15 wt % as calculated for $PO_4$.

8. The spark plug according to claim 1, wherein the chromium component comprising at least 90 wt % of trivalent chromium and the silicon component in an amount of 10 to 40 wt % as calculated for $SiO_2$ as cationic components.

9. The spark plug according to any one of claims 1 to 8, further comprising an annular gasket to be fitted around the basal end portion of a mounting threaded section formed on a peripheral surface of said main metal shell, at least a part of the surface of said gasket being coated with said complex chromate coat.

10. The spark plug according to claim 1 further comprising a zinc plate coat underlying said complex chromate coat, which, when subjected to "5. Neutral Salt Spray Test" according to the plate corrosion resistance test procedure specified in JIS H8502, can withstand for at least 40 hours before at least about 20% of the whole surface of the main metal shell is coated with white rust due to corrosion of the zinc plate coat.

11. The spark plug according to claim 1 further comprising a zinc plate coat underlying said complex chromate coat, which, when subjected to "5. Neutral Salt Spray Test" according to the plate corrosion resistance test procedure specified in JIS H8502 after heating at 200° C. for 30 minutes in air atmosphere, can withstand for at least 40 hours before at least about 20% of the whole surface of the main metal shell is coated with white rust due to corrosion of the zinc plate coat.

12. A method for producing a spark plug according to claim 1, said method including a chromating step which comprises immersing said main metal shell into a chromating bath containing phosphoric acid or a phosphate so as to form a phosphorus component dispersing chromate coat on the surface of said main metal shell, at least 90 wt % of the chromium component in said coat being trivalent chromium and the phosphorus component from said phosphoric acid or phosphate being present in an amount of 2 to 15 wt % as calculated for $PO_4$.

13. A method for producing a spark plug according to claim 1, said method including a chromating step which comprises immersing said main metal shell into a chromating bath containing an alkali silicate so as to form a silicon component dispersing chromate coat on the surface of said main metal shell, at least 90 wt % of the chromium component in said coat being trivalent chromium and the silicon component from said alkali silicate being present in an amount of 10 to 40 wt % as calculated for $SiO_2$.

14. The method for producing a spark plug according to claim 13, wherein said chromating bath also contains phosphoric acid or a phosphate and said silicon component dispersing chromate coat is such that the phosphorus component from said phosphoric acid or phosphate is present in an amount of 1 to 15 wt % as calculated for $PO_4$.

15. The spark plug according to claim 10, wherein said zinc plate coat has a thickness of about 3 to 10 $\mu$m.

16. The spark plug according to claim 11, wherein said zinc plate coat has a thickness of about 3 to 10 $\mu$m.

* * * * *